US009593571B2

(12) United States Patent
Rasmus et al.

(10) Patent No.: US 9,593,571 B2
(45) Date of Patent: Mar. 14, 2017

(54) DETERMINING CORRECT DRILL PIPE LENGTH AND FORMATION DEPTH USING MEASUREMENTS FROM REPEATER SUBS OF A WIRED DRILL PIPE SYSTEM

(71) Applicant: Schlumberger Technology Corporation, Sugar Land, TX (US)

(72) Inventors: John Rasmus, Richmond, TX (US); George Bordakov, Richmond, TX (US)

(73) Assignee: SCHLUMBERGER TECHNOLOGY COPRORATION, Sugar Land, TX (US)

( * ) Notice: Subject to any disclaimer, the term of this patent is extended or adjusted under 35 U.S.C. 154(b) by 455 days.

(21) Appl. No.: 14/284,668

(22) Filed: May 22, 2014

(65) Prior Publication Data

US 2014/0353037 A1 Dec. 4, 2014

Related U.S. Application Data

(60) Provisional application No. 61/829,201, filed on May 30, 2013, provisional application No. 61/829,260, filed on May 31, 2013.

(51) Int. Cl.
*E21B 47/04* (2012.01)

(52) U.S. Cl.
CPC ..... *E21B 47/04* (2013.01)

(58) Field of Classification Search
CPC ..... E21B 47/04; E21B 47/042
USPC ..... 340/854.1
See application file for complete search history.

(56) References Cited

U.S. PATENT DOCUMENTS

| | | | | |
|---|---|---|---|---|
| 5,642,051 | A | 6/1997 | Babour et al. | |
| 5,896,939 | A | 4/1999 | Witte | |
| 6,253,842 | B1 * | 7/2001 | Connell | E21B 21/103 166/255.1 |
| 6,641,434 | B2 | 11/2003 | Boyle et al. | |
| 8,181,510 | B2 | 5/2012 | Aldred et al. | |
| 8,362,915 | B2 | 1/2013 | Mehta et al. | |
| 2002/0195276 | A1 | 12/2002 | Dubinsky et al. | |
| 2006/0266552 | A1 | 11/2006 | Hutchinson | |

(Continued)

FOREIGN PATENT DOCUMENTS

WO 2004085796 A1 10/2004

OTHER PUBLICATIONS

International Search Report and the Written Opinion for the International Application No. PCT/US2014/039285 dated Sep. 29, 2014.

*Primary Examiner* — Kevin Kim

(57) ABSTRACT

A method includes accepting as input to a processor measurements of a characteristic of a subsurface formation made at a plurality of spaced apart positions along a pipe string moved along a wellbore. Measurements are made of pipe string depth in the wellbore from the Earth's surface. The measurements of pipe string depth include measurements of apparent depth of each of the spaced apart locations. The subsurface formation is identified from the measurements of the characteristic. A true depth of the subsurface formation is made using the measurements of pipe string depth and apparent depth of the formation from each of the spaced apart positions. A record of measurements of the characteristic with respect to depth corrected for changes in length of the pipe string caused by axial forces along the pipe string is generated.

19 Claims, 3 Drawing Sheets

(56) References Cited

U.S. PATENT DOCUMENTS

| | | | | |
|---|---|---|---|---|
| 2009/0235732 | A1 | 9/2009 | Difoggio | |
| 2010/0100685 | A1* | 4/2010 | Kurosawa | G06F 12/1054 711/128 |
| 2011/0102188 | A1 | 5/2011 | Mehta et al. | |
| 2013/0049982 | A1* | 2/2013 | Hartmann | E21B 47/00 340/854.1 |
| 2015/0090444 | A1* | 4/2015 | Partouche | E21B 41/0085 166/254.2 |

* cited by examiner

Depth
0000
1000
2000
3000
4000
5000
6000
Sensor C measurement
Sensor B measurement
Sensor A measurement
Sensor C
Sensor B
Sensor A
Formation 1
Formation 2
Time=0
Bit depth=1500
Time=1
Bit depth=3500
Time=3
Bit depth=6000
24
23B
20
23A
30
12
32
23C
44
42
40

DETERMINING CORRECT DRILL PIPE LENGTH AND FORMATION DEPTH USING MEASUREMENTS FROM REPEATER SUBS OF A WIRED DRILL PIPE SYSTEM

CROSS REFERENCE TO RELATED APPLICATIONS

This application claims the benefit of U.S. Provisional Application Ser. No. 61/829,201 entitled "Drill Pipe Length Corrections Using Wired Drill Pipe Measurements", filed May 30, 2013, and U.S. Provisional Patent Application Ser. No. 61/829,260 entitled "Determining Correct Drill Pipe Length and Formation Depth Using Measurements from Repeater Subs of a Wired Drill Pipe System."

BACKGROUND

The present disclosure relates generally to techniques for determining an accurate depth of an earth formation penetrated by a drill bit of a drilling system.

Wellbores are drilled in the earth, for among other purposes, to locate and produce hydrocarbons. Wellbore drilling includes the use of a drilling tool with a bit at one end that is advanced into the ground using a pipe called a "drill string" to form a wellbore. The drill string and the drilling tool are typically made of a series of tubular drill pipe sections that are connected together, such as by threaded connections, to form the drill string with the bit at the lower end thereof. In most drilling operations, as the drilling tool is advanced, drilling fluid (also called "drilling mud") is pumped through the drill string and the drilling tool and out through the drill bit to cool the drill bit and carry away drill cuttings. The drilling mud exits the drill bit and flows back up to the surface for cleaning and recirculation through the drill string. The drilling mud is also used to form a mud cake to line the wellbore.

A bottom hole assembly (BHA) may also be located in the drill string, typically proximate the drill bit. The BHA may contain one or more measurement-while-drilling ("MWD", for obtaining information/measurements about the drill string and/or the drill bit) and/or logging-while-drilling tools ("LWD", for obtaining data about the earth formation penetrated by the wellbore). Additionally, the BHA may include a power generation device (e.g., a mud turbine powered by the flow of drilling mud) and a rotary steering system for controlling the direction of the drill bit to drill the wellbore along a selected trajectory.

During the drilling operation, it is desirable to provide communication between the surface and the MWD and/or LWD tools. Wellbore telemetry devices are typically used to allow, for example, power, command and/or communication signals to pass between a surface unit and the MWD and/or LWD tools and/or rotary steerable system. These signals are used to control and/or power the operation of the MWD and/or LWD tools and to send information acquired in the wellbore, which may include information obtained by the MWD and/or LWD tools in the BHA.

Various wellbore telemetry systems may be used for the desired communication capabilities. Examples of such systems may include a wired drill pipe wellbore telemetry system as described U.S. Pat. No. 6,641,434, an electromagnetic wellbore telemetry system as described in U.S. Pat. No. 5,642,051, an acoustic wellbore telemetry system as described in International Patent Application Publication No. WO2004/085796. Other data communication devices, such as transceivers coupled to sensors, may also be used to transmit power and/or data between the surface and the above described devices in the BHA.

With wired drill pipe telemetry systems, the drill pipes that form the drill string are provided with special wired pipe joints. The wired drill pipe also have one or more repeaters that contain electronics to boost the signal transmitted through the wired drill pipe between, for example, a wellbore deployed tool and a surface unit. As shown, for example, in U.S. Pat. No. 6,641,434, such wired drill pipe telemetry systems can be provided with wires and inductive couplings that form a communication chain that extends through the drill string. The wired drill pipe is then operatively connected to the wellbore deployed tool and a surface unit for communication therewith. The wired drill pipe system is adapted to pass data received from components in the wellbore deployed tool to the surface unit and commands generated by the surface unit to the wellbore deployed tool. The repeaters can be placed at predetermined intervals along the drill pipe depending on the amount the signal needs to be boosted.

The length of the drill pipe joints and repeaters are measured at the surface at atmospheric conditions and this provides the depth reference for any measurements obtained from the BHA and the repeaters. When the drill pipe is in the well and suspended by a rig, the drill pipe is under tension due to the weight of the pipe. This creates an elongation of the drill pipe as compared to its length measured at the surface. Other environmental factors may increase or decrease the length of the pipe. These factors include temperature, internal verses external fluid pressures, accumulated turns due to torque, and amount of sliding and rotating friction forces acting on the pipe. Due to this elongation and distortion, it can be difficult to determine the actual depth of a formation penetrated by the drill bit.

DETAILED DESCRIPTION

Figure 1:
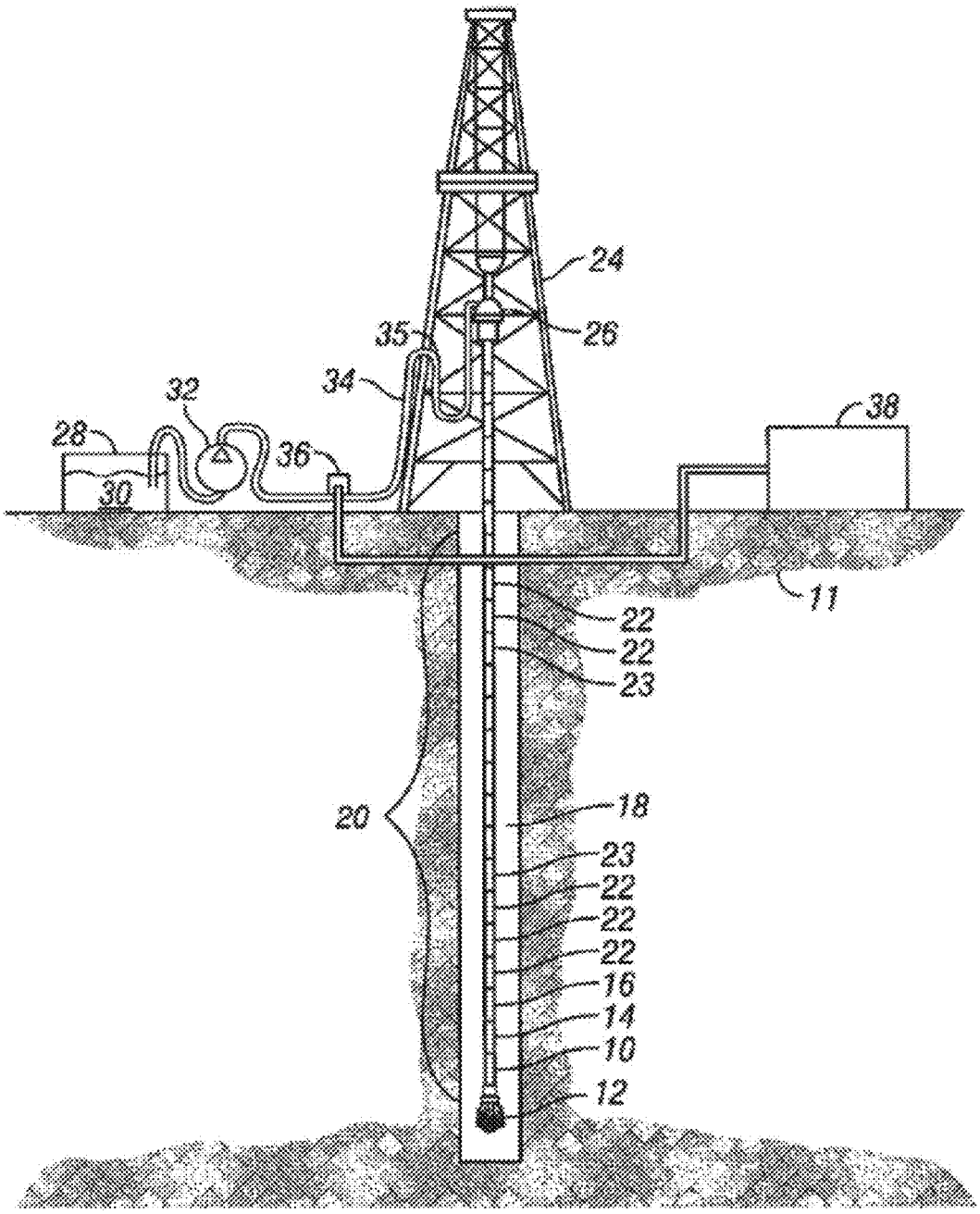
FIG. 1 shows an example drilling system using wired drill pipe telemetry in which embodiments of the present disclosure may be implemented.

Referring to FIG. 1, a simplified view of an example well site system is shown in which various embodiments according to the present disclosure can be used. The example well site system includes wired drill pipe that includes repeaters. The repeaters may include measurement devices for acquiring "along string measurements" (ASMs). In the present example, a drilling rig 24 or similar lifting device suspends a drill string 20 within a wellbore 18 being drilled through subsurface rock formations, shown generally at 11. The drill string 20 may be assembled by threadedly coupling together end to end a number of tubular segments (sometimes also called "joints") 22 of drill pipe. The drill string 20 may include a drill bit 12 at its lower end. When the drill bit 12 is axially urged into the rock formations 11 at the bottom of the wellbore 18 and it is rotated by equipment, such as a top drive system 26, such urging and rotation causes the bit 12 to axially extend ("deepen") the wellbore 18. It will be appreciated by those skilled in the art that the top drive 26 may be substituted in other embodiments by a swivel, kelly, kelly bushing and rotary table (not shown in FIG. 1) for rotating the drill string 20 while providing a pressure sealed passage through the drill string 20 for the flow of drilling mud 30. Accordingly, the disclosure is not limited in scope to use with top drive drilling systems.

During drilling of the wellbore 18, a pump 32 lifts drilling fluid ("mud") 30 from a tank 28 or pit and discharges the mud 30 under pressure through a standpipe 34 and flexible conduit 35 or hose, through the top drive 26 and into an interior passage (not shown separately in FIG. 1) inside the drill string 20. The mud 30 exits the drill string 20 through courses or nozzles (not shown separately) in the drill bit 12, where it then cools and lubricates the drill bit 12 and lifts drill cuttings generated by the drill bit 12 to the Earth's surface. The mud 30 that returns to the surface may be cleaned and returned to the tank 28 for reuse.

The drill string 20 may also include one or more measurement-while drilling (MWD) instruments 14 and/or logging-while-drilling (LWD) instruments 16. MWD instrument(s) 14 may be housed in a special type of drill collar, as is known in the art, and can contain one or more devices for measuring characteristics of the drill string and drill bit. The MWD instrument(s) 14 further includes an apparatus (not shown) for generating electrical power for the wellbore deployed system. This may typically include a mud turbine generator powered by the flow of the drilling mud 30. It is understood, however, that other power and/or battery systems may be used in different embodiments. In some embodiments, at least part of the power to operate the MWD instrument 14 and LWD instrument 16 may be obtained from the electrical conductors (not shown in FIG. 1) associated with the drill string 20.

The LWD instrument(s) 16 may also be housed in a special type of drill collar, as is known in the art, and can include one or more types of logging tools. The LWD instrument(s) 16 may include capabilities for measuring, processing, and storing information, as well as for communicating with the surface equipment, such as via a wired drill pipe telemetry system formed in part by the wired drill string 20. By way of example only, the LWD instrument(s) 16 may include at least one of a resistivity, nuclear (e.g., natural gamma ray, chemical-based sources, pulsed neutron generators, etc.), nuclear magnetic resonance (NMR), or acoustic logging tool, or a combination of such logging tools. In some embodiments, a rotary steerable system (RSS) may also be provided proximate to the drill bit 12. The lower end of the drill string 20 may include, at a selected position above and proximate to the drill bit 12, a hydraulic motor ("mud motor") 10 that may be used to provide rotational energy to the drill bit 12, as well as a rotary steerable system (not shown).

Some examples of MWD instrument 14 or LWD instrument 16 may include a telemetry transmitter (not shown separately) that modulates the flow of the mud 30 through the drill string 20. Such modulation may cause pressure variations in the mud 30 that may be detected at the Earth's surface by a pressure transducer 36 coupled at a selected position between the outlet of the pump 32 and the top drive 26. Signals from the transducer 36, which may be electrical and/or optical signals, for example, may be conducted to a recording unit, which may be part of a surface logging and control system 38. Such a recording unit may use decoding and interpretation techniques well known in the art. The decoded signals typically correspond to measurements made by one or more of the sensors (not shown) in the MWD instrument 14 and/or the LWD 16 instrument. Signals from the MWD and/or LWD instruments may also be communicated along the one or more electrical conductors (not shown in FIG. 1) associated with the drill string 20.

In the example shown in FIG. 1, at selected positions along the drill string 20, repeaters 23 having sensor(s) and measurement circuitry (not shown separately) may be provided. Each repeater 23 may contain circuits to amplify and condition signals originating from one direction along the conductors (not shown in FIG. 1) in the wired drill pipe and to transmit the amplified and conditioned signals in the other direction. By using such repeaters 23, it is possible to extend the length of the drill string 20 substantially while maintaining good signal communication in both directions. As will be described in more detail below, the measurement circuitry contained in the repeaters 23 may include one or more measurement devices, (e.g., sensors) to acquire a measurement of a formation characteristic. In some embodiments, such measurement devices may be integrated with the circuitry of the repeater 23, or may be separate therefrom but contained within the repeater 23. Thus, as used herein, the use of the phrase "along string measurements" made by the wired drill pipe repeaters or the like shall be understood to refer to measurements of formation characteristics made by measurement devices, such as suitably configured sensors, positioned where the repeaters 23 are, and not necessarily that the circuitry performing the function of signal boosting, conditioning, and/or amplification is making such measurements. It should also be clearly understood that the while present example is described in terms of repeaters used with a wired drill string, the scope of the present disclosure is not so limited. It is within the scope of the present disclosure to use sensors embodied in drill string compatible housings disposed at spaced apart locations along the drill string, which may include circuitry to make a time indexed record of measurements made by one or more sensors therein. Electrical power may be provided by batteries or by a drilling fluid flow operated turbine, in the matter of the MWD/LWD instrumentation described above. The time indexed record of the sensor measurements made by each sensor at its respective location along the drill string can be later correlated to a depth/time record made at the surface (explained below) to result in a measurement record with respect to depth. Accordingly, references to measurements made by the sensors in the repeaters 23 (ASMs) are intended to include within their scope measurements made by sensors having associated recording devices and not necessarily associated with a wired drill string.

The operation of drilling system of FIG. 1 may be controlled using the logging and control system 38, which may include one or more processor-based computing systems. In the present context, a processor may include a microprocessor, programmable logic devices (PLDs), field-gate programmable arrays (FPGAs), application-specific integrated circuits (ASICs), system-on-a-chip processors (SoCs), or any other suitable integrated circuit capable of executing encoded instructions stored, for example, on tangible computer-readable media (e.g., read-only memory, random access memory, a hard drive, optical disk, flash memory, etc.). Such instructions may correspond to, for instance, workflows and the like for carrying out a drilling operation, algorithms and routines for performing various inversions and/or interpretation processes using acquired logging data (e.g., for determining formation models), and so forth.

Figures 2, 3, 4, 5:
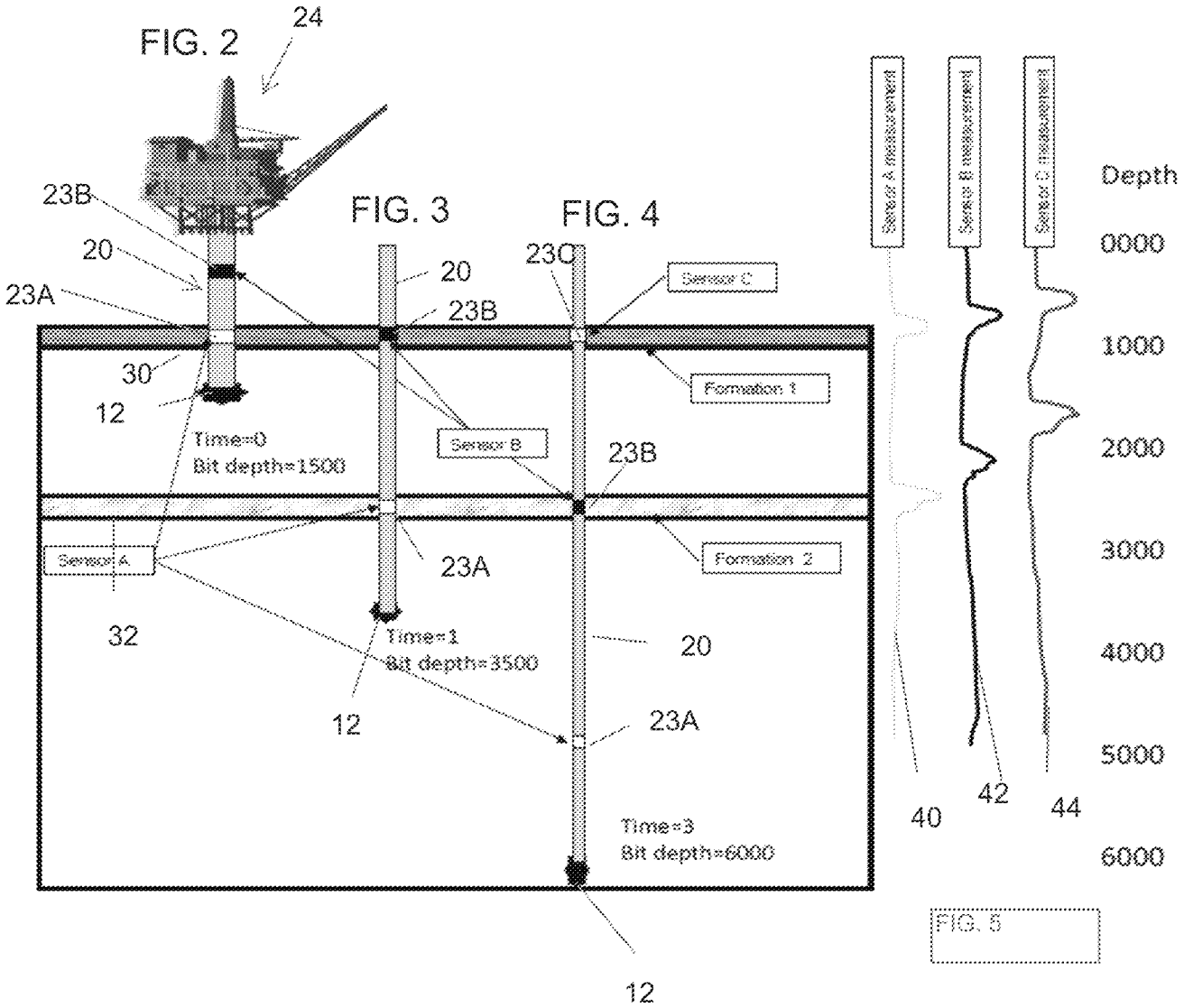
FIG. 2 illustrates a BHA and drill pipe drilling a section of well through formations using a wired drill string with a first repeater having a sensor associated therewith.
FIG. 3 shows a view similar to FIG. 2, but with additional drill string length and a second repeater having a sensor associated therewith.
FIG. 4 shows a view similar to FIG. 3, but with additional drill string length and a third repeater having a sensor associated therewith.
FIG. 5 shows measurements made by the various repeater sensors with respect to apparent depth.

FIGS. 2 through 4 illustrate the concept of having multiple ASM measurements in the wired drill pipe repeaters that are configured to measure any selected formation characteristic that allows for distinction between various formations as the wellbore is drilled. By way of example, and not to limit the scope of the present disclosure, one formation characteristic that may be measured by the ASM sensors is natural gamma-ray emission. However any other measurement such as formation resistivity, formation density, formation neutron porosity, formation gamma ray spectroscopy, formation nuclear magnetic resonance relaxation time distribution, formation velocity, acoustic impedance, formation photoelectric factor, etc. can be also used. In one embodiment, the ASM measurements may be all of the same type. In other embodiments, the ASM measurements may be different at each repeater. For example, a resistivity measurement made by one repeater may be correlated with a natural gamma ray measurement made by another repeater. The wired drill pipe provides a signal channel through which the measurements acquired by the ASM sensors can be transmitted to the surface.

Referring to FIG. 2, the drilling rig 2 is shown as the wellbore (not shown for clarity) is being drilled using the wired drill string 20. At the depth of the wellbore in FIG. 2, indicated by the position of the drill bit 12 the wired drill string 20 is only long enough to include a first repeater 23A and a second repeater 23B (or other sensor housings not part of a wired drill string as explained with reference to FIG. 1). When a first ASM measurement made by the sensor in the first repeater 23A (or other sensor as explained with reference to FIG. 1) passes and makes a measurement of a first formation 30 having characteristics enabling relatively easy distinction from the surrounding formations, which may be referred to as a "reference formation" 30 (at approximately 1000 feet depth), the axial load (as tension) in the drill string 20 will be relatively small. Therefore, any elongation effect will still be relatively small, and the drill string length in the wellbore will be only slightly longer than its length as measured at the surface. The measured length of a drill string at the surface, as will be understood by those skilled in the art, may be determined by adding together the nominal lengths of all of the components of the drill string (e.g., as shown in FIG. 1), including the drill bit, BHA and the number of segments ("joints") of drill pipe in the drill string. The nominal length of the assembled drill string components is known as the "pipe tally." The assembled drill string will be suspended a distance above the drilling rig "drill floor" (which may be referenced to a fixed elevation such as the ground surface or mean water level in marine drilling operations) by the top drive or kelly. The suspension distance is subtracted from the pipe tally, and a record with respect to time is made of the sum of the suspension distance and the pipe tally to generate a record with respect to time of the apparent depth of the drill bit 12 in the wellbore.

In the example of FIG. 2, the apparent depth of the first reference formation 30 on a "well log" (a record with respect to apparent depth of sensor measurements) may appear slightly shallower than the actual depth of the formation. This is illustrated in FIG. 5 by curve 40, which shows measurements made by the sensor in the first repeater 23A with respect to apparent depth. Again with reference to FIG. 2, as an example only, it may take 990 feet of drill pipe measured at the surface as explained above to stretch to 1000 feet and position the first repeater at the depth of the first reference formation 30. For the purposes of this disclosure, the measured logs in FIG. 5 are referenced to the length of drill string measured at the surface as explained above. The very right-hand of FIG. 5 indicates the actual depth in the subsurface with respect to the elevation reference or other absolute depth reference.

In FIG. 3, as the wellbore depth increases, eventually the second repeater 23B will be positioned adjacent to the first reference formation 30. The drilling rig is omitted from FIG. 3 for clarity of the illustration. Because the drill pipe now includes more segments, and is thus heavier, the axial loading in the drill string has increased correspondingly. Accordingly, the measurement made by the sensor in the second repeater 23B will record measurements that are identifiable with the first reference formation 30 as being at a shallower depth as compared to that of the first repeater 23A and the actual formation depth. The foregoing is clearly observable at curve 42 in FIG. 5.

Similarly, referring to FIG. 4, as a third repeater 23C eventually is positioned adjacent the first reference formation 30, the axial load in the drill string has further increased due to even more pipe being in the wellbore. As such, the measurements made by the sensor in the third repeater 23C will record the first reference formation 30 as being at an even shallower depth compared to the corresponding measurements made by the sensors in the first and second repeaters and the actual formation depth. This is clearly observable at curve 44 in FIG. 5.

A characteristic measurement "signature" corresponding to the first reference formation 30 will repeat for every subsequent ASM measurement (made by a sensor in a subsequent repeater) as it passes the first reference formation 30. Deeper formations, such as a second formation 32 (at approximately 2500 feet actual depth and which may be also referred to as a reference formation), may have corresponding, but exaggerated depth shifted signatures, due to the increased tensile loads in the drill string. In the illustrated example in FIG. 5, the first repeater (23A in FIG. 2) sensor indicates the second reference formation (32 in FIG. 4) as being located at approximately 2600 feet, the second repeater sensor indicates the second reference formation as being located at approximately 2100 feet, and the third repeater sensor (23C in FIG. 4) indicates the second reference formation as being located at approximately 1800 feet, while the actual depth of the second reference formation is at approximately 2700 feet.

There is a "neutral point" in the drill string, which typically is in the BHA. The neutral point refers to the point at which the BHA is in compression below, and is in tension above. Therefore the drill pipe portion of the drill string is always in tension by design. In highly inclined and/or horizontal wellbores, the neutral point may move toward the surface as a result of part of the weight of the drill string being suspended by the bottom of the wellbore. As the neutral point shifts upwardly, the apparent measurement depth offsets may appear deeper instead of shallower. The addition of a weight or strain measuring device within each repeater may enable a more accurate elongation calculation to be made because it is thus possible to estimate or determine the axial loading distribution along the length of the drill string. If no axial loading measurements are available, i torque and drag modeling programs known in the art can be used to estimate the axial loading distribution along the length of the drill string.

Essentially, FIGS. 2 through 4 illustrate a BHA and successively longer drill pipe drilling a section of well through multiple formations, with measurement sensors placed in each of the corresponding repeaters in the wired drill pipe. The resulting measurements may be plotted as a log of measurement verses depth as computed from the pipe tally. The apparent depth as observed on the measured well logs thus may vary with each repeater's sensor and the total length of drill pipe placed in the wellbore. In accordance with aspects of the present disclosure, an inversion procedure may be used to determine the true formation depth.

An explanation of the inversion procedure follows. Young's modulus is defined below in Eq. 1 as:

$$E = \left(\frac{F/A}{\Delta L/L}\right) \qquad (1)$$

$$\Delta L = L \times \left(\frac{F/A}{E}\right)$$

wherein E represents Young's Modulus, F represents force acting on an element, A represents cross-sectional area of the element, ΔL represents length change of the element due to F, and L represents length of the element.

Ignoring other environmental effects, the depth of any formation measured by a given sensor and influenced only by the amount of pipe elongation due to axial forces along the drill string can be written as shown below in Eq. 2 (using the first reference formation and the sensor in the first repeater as examples):

$$Depth_{formation_1} = L_{pipetally_sensor_A} + L_{pipetally_sensor_A} \times \left(\frac{F_{pipe}/A_{pipe}}{E_{pipe}}\right) + \Delta L_{misc}$$

Where:

$Depth_{formation_1}$=true depth of formation 1

$L_{pipetally_sensor_A}$=length of drillpipe at sensor A as measured at surface from pipe tally $F_{pipe}$=tensile forces acting on pipe from surface to sensor A $A_{pipe}$=average cross-sectional area of pipe from surface to sensor A $E_{pipe}$=average Young's modulus of pipe from surface to sensor A $\Delta L_{misc}$=length change due to other environmental factors, such as temperature, annular vs. internal pressured, etc. (2)

As each of the various sensors acquiring the ASM measurements will eventually pass the same formation, additional equations can be written as shown in Eq. 3 below.

$$Depth_{formation_1} = L_{pipetally_sensor_n} + L_{pipetally_sensor_n} \times \left(\frac{F_{pipe}/A_{pipe}}{E_{pipe}}\right) + \Delta L_{misc}$$

Where:

$Depth_{formation_1}$=true depth of formation 1

$L_{pipetally_sensor_n}$=length of drillpipe at sensor n as measured at surface from pipe tally $F_{pipe}$=tensile forces acting on pipe from surface to sensor n $A_{pipe}$=average cross-sectional area of pipe from surface to sensor n $E_{pipe}$=average Young's modulus of pipe from surface to sensor n (3)

There will be the same number of equations as there are ASM sensors each making measurements of a characteristic of each formation. For example, if there are five ASM sensors in the drill string, there will be five independent equations as above for each formation. Therefore, five unknowns can be solved for which would include at least the true depth of each formation, the average cross-sectional area of the drill pipe, and the average Young's modulus of the drill pipe.

Further, in any particular wellbore, there may be a large number of different formations that will be measured by each repeater's sensor, resulting in (n_sensors×m_formations) equations, as shown below in Eq. 4. Eq. 3 can be generalized to account for the fact that F, A, $\Delta L_{misc}$, and E may be desirable to be determined for each section of drill pipe between each ASM sensor. At least five ASM sensors measuring each formation can be used to solve for the five unknowns: $Depth_{formation_m}$, $F_{pipe_n}$, $A_{pipe_n}$, $E_{pipe_n}$, and $\Delta L_{misc}$.

$$Depth_{formation_1 \ldots m} = L_{pipetally_sensor_1 \ldots n} + L_{pipetally_sensor_1 \ldots n} \times \left(\frac{F_{pipe_1 \ldots n}/A_{pipe_1 \ldots n}}{E_{pipe_1 \ldots n}}\right) + \Delta L_{misc} \qquad (4)$$

The simultaneous solution of Eq. 3 can be enhanced by adding constraints or expected limits on the values of A and/or E. The addition of weight or stress measurements at each repeater can also allow for the estimation of F directly at each repeater. It may also be possible to use the individual axial loading (weight or stress) measurements made at each sensor to determine an axial loading distribution along the length of the drill string and adjust the true formation depth accordingly. Additionally, $\Delta L_{misc}$ can be estimated from measured ASM temperatures and/or measured ASM pressures. Any of these techniques can allow for a more robust determination of the actual formation depth.

The result of the inversion may be a two dimensional type plot of each ASM measurement versus depth (e.g., as shown in FIG. 5) and depth-corrected for the various drill pipe axial loading corrections. These measurement logs may then be used for subsequent measured correlation logs on wireline or for cased hole measurements.

With respect to drill pipe elongation caused apparent measurement depth as compared to surface measurements, it will be appreciated that certain environmental factors such as temperature, drill string accumulated torque, and/or internal versus external pressures, may also affect elongation/distortion of the drill pipe. In one embodiment, each repeater and associated ASM sensor may further include a torque measurement sensor. Adding such sensors enables determining the torque distribution along the length of the drill string. Taken together with the ASM measurements of a formation characteristic and/or the addition of a weight sensor and/or a tension sensor, at least some of the above-mentioned environmental effects can be determined.

The number of repeaters having the foregoing sensors can be variable. In one embodiment, at least 5 ASM sensors are provided. To incorporate the effects of pipe elongation and/or distortion due to temperature effects, the variable $\Delta L_{misc}$ in the formulas above can be expressed as shown in Eq. 5 below in the following way:

$$\Delta L_{misc}=\{\Sigma_{i=1}^{N}L_{i\ pipetally}E_{i\ pipetally}[(\Sigma_{j=1}^{N_{temp}\ i}w_{ij}T_{ij})-T_a]f_i\}+\Delta L_{misc\ other} \quad (5)$$

The variables in Eq. 5 may be defined as follows:

$L_{i\ pipetally}$ is the length of the i-th pipe joint at ambient conditions with N being the total number of pipe joints;

$E_{i\ pipetally}$ represents a thermal expansion coefficient;

$T_{ij}$ are temperatures at similarly allocated j-positions (for example, beginning and end for inside and outside, totally $N_{temp\ i}$ positions) of i-th pipe joint with weights $w_{ij}$ used to for expansion calculation so that: $\Sigma_{j=1}^{N_{temp}\ i}w_{ij}=1$;

$T_a$ is ambient temperature (at which pipe tally length is measured);

$f_i$ is a relative factor that describes how much of the tubular is in the borehole (it is 1 except the very top tubular, for which it can be assumed a fraction of which is actually in borehole);

$\Delta L_{misc\ other}$, for the purposes of this example, represents other factors which are at least order of magnitude less than temperature-related extension and may be neglected in this example.

Assuming that the drill pipe segments of the drill string include substantially mechanically identical pipe joints attached to each other and neglecting boundary effects (which, in this example, can be considered as being an order of magnitude less compared to temperature expansion), one may derive Eq. 6 below.

$$\Delta L_{misc}=\frac{L_{pipetally}E_{pipetally}}{N}\sum_{i=1}^{N}\left[\left(\sum_{j=1}^{N_{temp}}w_jT_{ij}\right)-T_a\right] \quad (6)$$

In Eq. 6. weights $w_j$ may be assigned based on the result of thermal extension modeling under stress for an individual pipe joint using, for example, commercially available modeling packages. In one embodiment, a suitable starting point can be achieved by assigning equal weights:

$$w_j=\frac{1}{N_{temp}}$$

However, if it is assumed that the wired drill pipe system is made up of several substantially different types of pipe joints (e.g., pipe and heavy pipe) the formula shown above in Eq. 6 may be rewritten as shown below in Eq. 7:

$$\Delta L_{misc}=\left\{\sum_{k=1}^{K}\frac{L_{k\ pipetally}E_{k\ pipetally}}{N_k}\sum_{i=1}^{N_k}\left[\left(\sum_{j=1}^{N_{temp}\ k}w_{kj}T_{ij}\right)-T_a\right]\right\}, \quad (7)$$

wherein the index k refers to the type of pipe joint and $N_k$ is the number of pipe joints of each type. In one embodiment, a condition may be established in which the pipe joint types accounted for in Eq. 7 are those that represent at least a threshold percentage of the total drill string length, with those that do not make up at least a threshold percentage of the drill string length being excluded. Temperatures $T_{ij}$ (i.e., the temperature distribution along the length of the drill string) can be determined by interpolation between repeater sensor measurements (e.g., can use commercially available modeling packages). In one embodiment, a suitable starting point can be determined by using linear interpolation done separately for inside and outside temperatures using repeater temperature measurements separately.

Assuming the simplifications noted above, in the case where the drill string is made up of substantially identical pipe joints, $\Delta L_{misc}$ can be determined as follows.

$$\Delta L_{misc}=\frac{L_{pipetally}E_{pipetally}}{N}\sum_{i=1}^{N}[w_{out}T_{i\ out}+w_{in}T_{i\ in}-T_a] \quad (8)$$

Here, the index i now refers to the i-th repeater and the subscripts "in" and "out" designate inside and outside temperature measurements, respectively. Weights may be ideally selected to satisfy the condition: $w_{out}+w_{in}=1$. In one example, the weights may each initially be assigned equal values of 0.5.

In a case where the drill string is made up of several substantially different types of pipe joints and applying the simplifications noted above, $\Delta L_{misc}$ can be determined as follows:

$$\Delta L_{misc}=\left\{\sum_{k=1}^{K}\frac{L_{k\ pipetally}E_{k\ pipetally}}{N_k}\sum_{i=1}^{N_k}[w_{k\ out}T_{i\ out}+w_{k\ in}T_{i\ in}-T_a]\right\} \quad (9)$$

In Eq. 9, the index k refers to the type of pipe joint and $N_k$ is the number of pipe joints of each type. Sensor measurements may now be assigned different weights depending on the type of pie joint on which the particular sensor is located. As before, the weights may be selected such that they satisfy the condition $w_{k\ out}+w_{k\ in}=1$ and, like before, initially the weights could be assigned equal values of 0.5.

$\Delta L_{misc}$ as determined in accordance with Eq. 8 or Eq. 9, can then be substituted into Eq. 3 and Eq. 4. With $\Delta L_{misc}$ included here, ASM sensor readings can be used to correct the thermal expansion coefficients $E_{pipetally}$ and the weights $w_{out}$, $w_{in}$ (or $w_{k\ out}$, $w_{k\ in}$ for cases with different tubular types) to match ASM measurements.

In one implementation, for further improving accuracy, the system represented by Eq. 4 may be over-determined, i.e. by using more repeater sensor measurements than necessary, and the solution may be derived by minimizing sum of squares of differences (or sum of absolute values of differences or sum of some positive power of absolute values of differences) between actual ASM sensor measurements and their respective estimates based on Equation 4.

As will be understood, the various techniques described above and relating to the determination of formation depth based on along-string measurements acquired using sensors placed with repeaters in wired drill pipe systems are provided by way of example only. Accordingly, it should be understood that the present disclosure should not be construed as being limited to only the examples provided above. Further, it should be appreciated that the processes represented by the various equations above may be implemented in any suitable manner, including hardware (suitably configured circuitry), software (e.g., via a computer program including executable code stored on one or more tangible computer readable medium), or via using a combination of both hardware and software elements.

Figure 6:
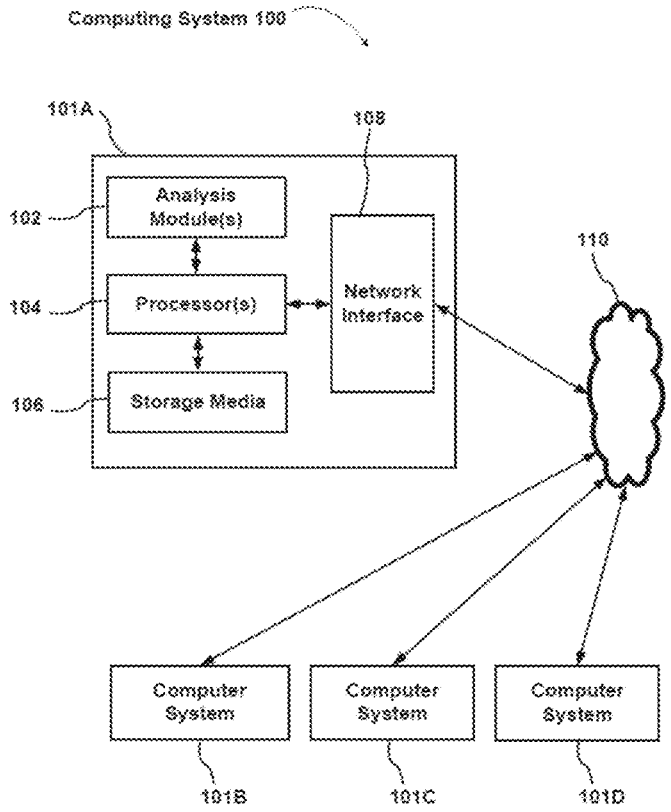
FIG. 6 shows an example computer system that may be used in some embodiments.

FIG. 6 shows an example computing system 100 in accordance with some embodiments. The computing system 100 may be an individual computer system 101A or an arrangement of distributed computer systems. The computer system 101A may include one or more analysis modules 102 that may be configured to perform various tasks according to some embodiments, such as the tasks depicted in FIGS. 2 through 4. To perform these various tasks, an analysis module 102 may execute independently, or in coordination with, one or more processors 104, which may be connected to one or more storage media 106. The processor(s) 104 may also be connected to a network interface 108 to allow the computer system 101A to communicate over a data network 110 with one or more additional computer systems and/or computing systems, such as 101B, 101C, and/or 101D (note that computer systems 101B, 101C and/or 101D may or may not share the same architecture as computer system 101A, and may be located in different physical locations, for example, computer systems 101A and 101B may be at a well drilling location, (e.g., in the logging and control unit 38 in FIG. 1) while in communication with one or more computer systems such as 101C and/or 101D that may be located in one or more data centers on shore, aboard ships, and/or located in varying countries on different continents).

A processor can include a microprocessor, microcontroller, processor module or subsystem, programmable integrated circuit, programmable gate array, or another control or computing device.

The storage media 106 can be implemented as one or more computer-readable or machine-readable storage media. Note that while in the example embodiment of FIG. 6 the storage media 106 are depicted as within computer system 101A, in some embodiments, the storage media 106 may be distributed within and/or across multiple internal and/or external enclosures of computing system 101A and/or additional computing systems. Storage media 106 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the instructions discussed above may be provided on one computer-readable or machine-readable storage medium, or alternatively, can be provided on multiple computer-readable or machine-readable storage media distributed in a large system having possibly plural nodes. Such computer-readable or machine-readable storage medium or media may be considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

It should be appreciated that computing system 100 is only one example of a computing system, and that computing system 100 may have more or fewer components than shown, may combine additional components not depicted in the example embodiment of FIG. 6, and/or computing system 100 may have a different configuration or arrangement of the components depicted in FIG. 6. The various components shown in FIG. 6 may be implemented in hardware, software, or a combination of both hardware and software, including one or more signal processing and/or application specific integrated circuits.

Further, the steps in the processing methods described above may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of the present disclosure.

While the specific embodiments described above have been shown by way of example, it will be appreciated that many modifications and other embodiments may be readily devised by one skilled in the art having the benefit of the foregoing description and the associated drawings. Accordingly, it is understood that various modifications and embodiments are intended to be included within the scope of the appended claims.

What is claimed is:

1. A method comprising:

accepting as input to a computer measurements of a characteristic of a subsurface formation made at a plurality of spaced apart positions along a pipe string moved along a wellbore;

accepting as input to the computer measurements of pipe string depth in the wellbore made at the Earth's surface, the measurements of pipe string depth including measurements of apparent depth of each of the spaced apart locations;

in the computer, identifying the subsurface formation from the measurements of the characteristic;

in the computer determining a true depth of the subsurface formation using the measurements of pipe string depth and apparent depth of the formation from each of the spaced apart positions; and generating a record of measurements of the characteristic with respect to depth corrected for changes in length of the pipe string caused by axial forces along the pipe string.

2. The method of claim 1, wherein the pipe string comprises a wired drill pipe system, and wherein the spaced apart locations are disposed in different pipe joints containing repeaters in the wired drill pipe system.

3. The method of claim 1, wherein the characteristic comprises a same type of measurement at each of the spaced apart locations.

4. The method of claim 1, wherein the characteristic comprises a different type of measurement at at least one of the spaced apart locations than a type of measurements made at at least one other of the spaced apart locations.

5. The method of claim 1, wherein the characteristic comprises at least one of formation resistivity, formation density, formation neutron porosity, formation gamma ray spectroscopy, formation nuclear magnetic resonance relaxation time distribution, formation velocity, acoustic impedance and formation photoelectric factor.

6. The method of claim 1 further comprising accepting as input to the computer measurements of axial loading on the pipe string made at the spaced apart locations and in the computer further correcting the record for axial loading distribution along the pipe string.

7. The method of claim 6 wherein the axial loading measurements are made using a strain gauge disposed at each of the spaced apart locations.

8. The method of claim 1 further comprising accepting as input to the computer measurements of torque on the pipe string at the spaced apart locations and in the computer further correcting the record for torsional loading distribution along the pipe string.

9. The method of claim 1 further comprising accepting as input to the computer measurements of temperature at the spaced apart locations and in the computer further correcting the record for thermal expansion distribution along the pipe string.

10. The method of claim 1 wherein the pipe string is moved along the wellbore by drilling the wellbore and wherein a length of the pipe string is lengthened corresponding to a drilled length of the wellbore.

11. A method, comprising:

extending a drill string into a wellbore by lengthening the wellbore, the lengthening comprising rotating a drill bit at a bottom end of the drill string;

recording an apparent depth of the drill bit in the wellbore using a pipe tally and a measurement of elevation of an upper end of the drill string above a selected elevation reference;

making measurements of a formation characteristic at spaced apart locations along the drill string while lengthening the wellbore;

identifying at least one formation from the measurements of the characteristic made at each of the spaced apart locations; and determining a true depth of the at least one formation using the measurements of the characteristic and the apparent depth.

12. The method of claim 11, wherein the drill string comprises a wired drill pipe system, and wherein the spaced apart locations are disposed in different pipe joints containing repeaters in the wired drill pipe system.

13. The method of claim 11, wherein the formation characteristic comprises a same type of measurement.

14. The method of claim 11, wherein the formation characteristic comprises a different type of measurement at at least one of the spaced apart locations than a type of measurements made at at least one other of the spaced apart locations.

15. The method of claim 11, wherein the formation characteristic comprises at least one of formation resistivity, formation density, formation neutron porosity, formation gamma ray spectroscopy, formation nuclear magnetic resonance relaxation time distribution, formation velocity, acoustic impedance and formation photoelectric factor.

16. The method of claim 11 further comprising measuring axial loading on the drill string made at the spaced apart locations and further correcting the true depth for axial loading distribution along the drill string.

17. The method of claim 16 wherein the axial loading measurements are made using a strain gauge disposed at each of the spaced apart locations.

18. The method of claim 11 further comprising measuring torque on the drill string at the spaced apart locations and further correcting the true depth for torsional loading distribution along the drill string.

19. The method of claim 11 further comprising measuring temperature at the spaced apart locations and further correcting the true depth for thermal expansion distribution along the drill string.

* * * * *